United States Patent [19]

Carter

[11] Patent Number: 4,750,427

[45] Date of Patent: Jun. 14, 1988

[54] BULLET

[76] Inventor: Herman L. Carter, P.O. Box 262348, Houston, Tex. 77207

[21] Appl. No.: 11,581

[22] Filed: Feb. 6, 1987

[51] Int. Cl.[4] ..... F42B 11/08

[52] U.S. Cl. ..... 102/516; 102/517

[58] Field of Search ..... 102/439, 501, 502, 507–510, 102/514–519

[56] References Cited

U.S. PATENT DOCUMENTS 2,792,618 5/1957 Walker ..... 102/514 X
4,517,898 5/1985 Davis et al. ..... 102/514

FOREIGN PATENT DOCUMENTS 10377 8/1885 Fed. Rep. of Germany ..... 102/514
48041 8/1889 Fed. Rep. of Germany ..... 102/514
308593 12/1919 Fed. Rep. of Germany ..... 102/516
776005 1/1935 France ..... 102/501

*Primary Examiner*—Harold J. Tudor
*Attorney, Agent, or Firm*—Vaden, Eickenroht, Thompson & Boulware

[57] ABSTRACT

A bullet is disclosed that includes a generally cylindrical outer jacket of copper base material having an inner cavity that is closed at one end to provide a solid nose for the bullet. The nose has a minimum longitudinal thickness that is equal to or greater than about 10% of the length of the bullet and a flat face symmetrically located with respect to and perpendicular to the longitudinal axis of the bullet. The face covers at least thirty-five percent of the cross-sectional area of the bullet. The inner cavity of the outer jacket is filled with lead.

4 Claims, 1 Drawing Sheet

FIG. 1
(PRIOR ART)
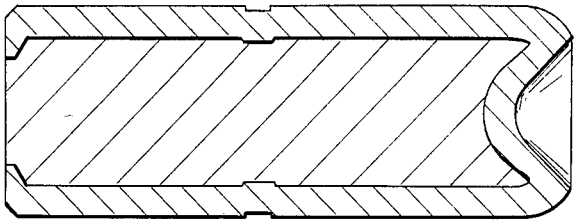
FIG. 2
(PRIOR ART)
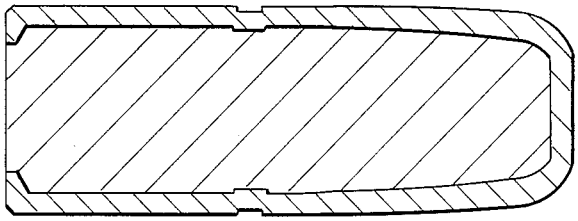
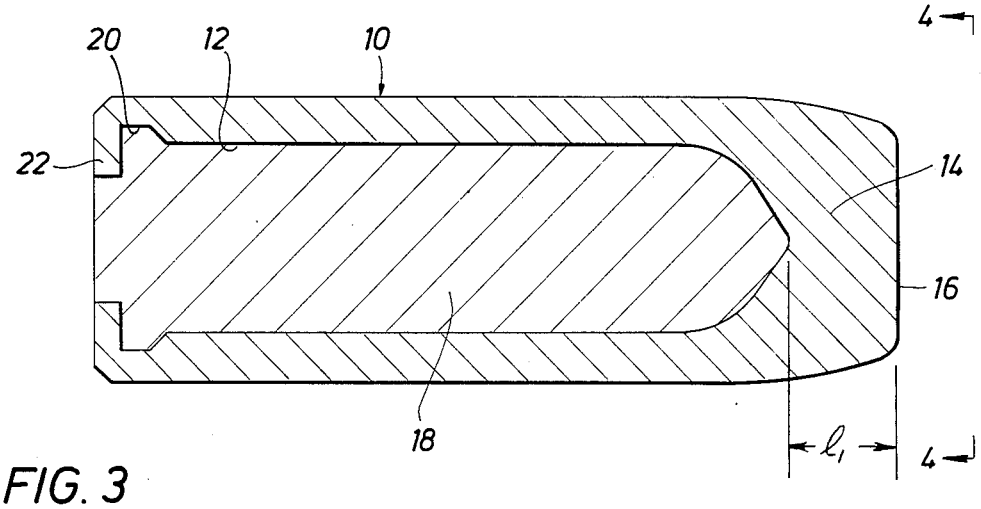
FIG. 3
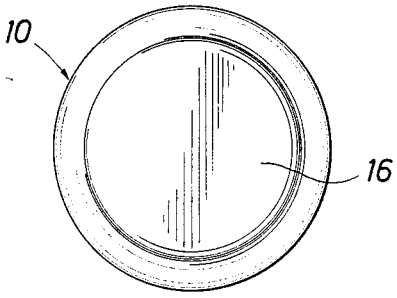
FIG. 4

BULLET

This invention relates to bullets generally and in particular to full metal jacket bullets for use in hunting big and dangerous game, such as Cape buffalo, elephant, hippopotamus, and rhinoceros.

A full metal jacketed bullet includes a generally cylindrical outer jacket having an inner lead filled cavity that is closed at one end to provide a solid nose for the bullet. Such bullets are generally referred to as "solids". The ideal solid bullet should create a larger wound channel, produce greater impact shock, and have straighter penetration all while maintaining its structural integrity.

Previous solids have had the conventional tapered nose, i.e., shaped along an ogive curve. Two prior art solids departed from the curved nose and the cross-sections of these solids are shown in FIGS. 1 and 2. The solid bullet shown in FIG. 1 was designed by a Montana gunsmith in early 1960. It was an experimental bullet as best that can be determined. It is not known if any were sold, but apparently none were successful in accomplishing the desired characteristics of the solid bullet. The solid bullet shown in FIG. 2 was manufactured and sold by Winchester. It was on the market briefly and then discontinued. Again, apparently the bullet did not produce the desired results. As will be explained below, it is believed that the failure of the Winchester solid bullet was due to lack of structural strength because of the relatively thin walls of the jacket and the thin solid nose along with the relatively small flat area that covers only about 23% of the total cross-sectional area of the bullet.

In accordance with this invention, it has been determined that a solid bullet should have a flat nose covering an area that is at least 35% of the cross-sectional area of the bullet, preferably more. It has also been determined that the longitudinal thickness of the solid nose portion of the outer jacket must be equal to or greater than about 10% of the length of the bullet, preferably around 14% to 15% as this will provide the structural strength required on impact and yet not overly reduce the space allowed for the lead that fills the cavity and provides most of the weight of the bullet. In addition, the diameter of the cavity in the outer jacket in which the lead is located should be no greater than about 75% of the outside diameter of the bullet, preferably around 60% to provide side walls having sufficient structural strength to resist buckling under impact shock.

It is an object of this invention to provide such a solid bullet.

This and other objects, advantages, and features of this invention will be apparent to those skilled in the art from a consideration of this specification, including the attached drawings and appended claims.

IN THE DRAWINGS

FIGS. 1 and 2 are cross-sectional views of the two bullets discussed above;

FIG. 3 is a cross-sectional view of the preferred embodiment of the solid bullet of this invention; and FIG. 4 is a view looking in the direction of the arrows 4—4 of FIG. 3.

In the preferred embodiment of FIG. 3, the bullet includes a generally cylindrical outer jacket 10 of copper base material (naval bronze in the preferred embodiment) having an inner cavity 12 that is closed at one end to provide solid nose 14. The distance $l_1$ which is the minimum thickness of the nose, should be no less than 10% of the total length of the bullet in order to provide the nose of the bullet with sufficient strength to resist distortion upon impact. As stated above, it has been determined that the bullet should have a flat face on the nose rather than having a pointed nose and that the area of this flat face should be substantial, as compared to the cross-sectional area of the bullet. Specifically, it should be at least 35% of the cross-sectional area of the bullet and preferably 50–60%. Nose 16 is about 56% of the cross-sectional area of the bullet. Contrary to expectations, such a large flat surface reduces bullet veer and tumble, causes it to generally travel straight to the game animal, and to travel into and/or through the game animal in a straight line. The rather large flat surface also creates a large wound channel and produces greater impact shock than the prior art solid bullets.

Cavity 12 is filled with hard lead 18 to provide the required mass for the bullet. To help hold the lead in cavity 12, annular groove 20 is located adjacent the open end of cavity 12 and the open end of the cavity is reduced by inwardly extending flange 22. The combination of annular groove 20, which is filled with lead, and the inwardly extending flange 22, hold the solid mass of lead in cavity 12 and prevent it from separating from the bullet.

Experimental bullets of the type shown in FIG. 3 have been used to take Cape buffalo, elephant, hippopotamus, and rhinos and in each case, the bullet has not ruptured or been deformed in any perceptible way.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A bullet comprising a generally cylindrical outer jacket of copper base material having an inner cavity that is closed at one end to provide a solid nose for the bullet having a longitudinal thickness equal to or greater than about 10% of the length of the bullet and a flat face symmetrically located with respect to and perpendicular to the longitudinal axis of the bullet, said face covering at least thirty-five percent of the cross-sectional area of the bullet, and a lead core that fills the inner cavity of the outer jacket.

2. The bullet of claim 1 in which the flat face of the nose of the bullet is between 50% and 60% of the cross-sectional area of the bullet.

3. The bullet of claim 1 or 2 in which the diameter of the cavity is between 60% and 75% of the outside diameter of the bullet to provide side walls having sufficient structural strength to resist buckling under impact shock.

4. The bullet of claim 1 in which the jacket has an inner groove adjacent the open end of the jacket cavity and an inwardly extending flange to help hold the lead core in the cavity.

* * * * *